US005226272A

United States Patent [19]

Sauve

[11] Patent Number: 5,226,272

[45] Date of Patent: Jul. 13, 1993

[54] WATER CONTROLLING BUILDING BLOCK

[75] Inventor: Dennis L. Sauve, Belle River, Canada

[73] Assignee: Newblock Corporation, Belle River, Canada

[21] Appl. No.: 713,094

[22] Filed: Jun. 11, 1991

[51] Int. Cl.[5] ..... E02D 19/00

[52] U.S. Cl. ..... 52/169.5; 52/286; 52/589; 52/593

[58] Field of Search ..... 52/169.5, 302, 303, 52/606, 284–286, 561–565, 593, 589, 505

[56] References Cited

U.S. PATENT DOCUMENTS

| | | | |
|---|---|---|---|
| 1,336,025 | 4/1920 | Cook | 52/284 |
| 1,746,816 | 2/1930 | Boes | 52/303 X |
| 1,771,275 | 7/1930 | Stamm . | |
| 2,157,290 | 5/1989 | Henderson | 52/303 X |
| 2,316,319 | 4/1943 | Demarest . | |
| 2,530,940 | 11/1950 | Paalin | 52/505 X |
| 2,668,435 | 2/1954 | Clements | 52/686 X |
| 3,287,866 | 11/1966 | Belilacqua | 52/169.5 |
| 4,640,071 | 2/1987 | Haener | 52/286 |
| 5,115,614 | 5/1992 | McGrath | 52/169.5 |

FOREIGN PATENT DOCUMENTS

| | | |
|---|---|---|
| 52375 | 5/1977 | Australia . |
| D34571 | 11/1971 | Canada . |
| D43479 | 4/1978 | Canada . |
| D44135 | 9/1978 | Canada . |
| 2203824 | 8/1973 | Fed. Rep. of Germany . |
| 2346514 | 4/1976 | France . |
| 611285 | 10/1948 | United Kingdom . |
| 778527 | 7/1957 | United Kingdom . |

OTHER PUBLICATIONS

Six page brochure by Block & Products, Inc. ("Betco") titled "Bet-Roc Custom Concrete Masonry Units".

*Primary Examiner*—Richard E. Chilcot, Jr.
*Attorney, Agent, or Firm*—Bereskin & Parr

[57] ABSTRACT

A hollow rectangular concrete building block is provided having features which prevent and impede the infiltration of water into and migration of water through the block. The hollow block conventionally includes parallel interior and exterior vertical walls with at least one transverse vertical web spanning between the walls to form a unitary block with an interior cavity. Migration of water from the exterior to interior is impeded by a plurality of vertical ribs protruding from each side surface of the web. Water which has penetrated into the block cavity is redirected downwardly, as it trickles across the web, by the ribs to be ultimately expelled at the base of the block array with conventional flashing and weep holes. Grooves in the upper surface of the webs prevent migration of water along the upper surface and redirect the water to flow downwardly along the side surfaces of the web. The upper exterior edge of the exterior wall of the block may preferably be beveled particularly in the application of the invention to architectural masonary units where the mortar beads may be inset from the block faces up to ¾ of an inch for visual effect. Bevelling the exterior edge is done to prevent pooling of water in the mortar joint area; to shed water downwardly along the exterior surface of the exterior wall; and to enable access to the joint for sufficient compaction of the mortar joint prior to setting, thereby minimizing cracks in the finished mortar through which water may infiltrate into the block cavity.

29 Claims, 2 Drawing Sheets

WATER CONTROLLING BUILDING BLOCK

TECHNICAL FIELD

The invention relates to a hollow building block having novel features to prevent and impede the infiltration of water into and migration of water through the block.

BACKGROUND TO THE INVENTION

Hollow building blocks, generally cast of concrete, are commonly used to erect longitudinal vertically stacked arrays of like blocks to form building walls and interior partitions. A bead of mortar is placed along the interior and exterior upper edges of a base course of blocks, and along the interior and exterior side edges of the placed block to join the stacked array of blocks together. Before the mortar sets or hardens, the outer surface of the mortar bead between the stacked blocks is tooled. Tooling involves compacting, shaping and smoothing the outer mortar surface with a generally semi-circular shaped tool to ensure that no voids or cracks remain in the mortar joint which would allow moisture penetration, and to give the desired finished joint appearance.

Infiltration of water through cracks in the mortar or block, and migration of water through the hollow block from the exterior of a building to the interior is a major problem. Ground water may pass through basement walls and rain water may pass through other walls resulting in damage to the building structure and contents. A variety of causes account for water penetration of block walls including: wall settlement; improper mortar compaction or composition; voids in mortar or block; and inherent permeability of the mortar and block material.

Basement walls are often made of cast-in-place concrete. Concrete and block basement walls are coated on their exterior with waterproofing coatings such as tar to prevent leakage of ground water. Above ground cavity walls are constructed comprising an exterior brick layer and an interior block layer defining a cavity and the layers being connected with metal ties. Cavity walls have metal flashing and weep holes at their base to expel water above the ground level. Since cavity walls are really two separate walls tied together, the costs involved are relatively high compared to a single thickness block wall. Transparent chemical coatings have also been applied to the exterior of masonry walls to seal them, however, the service life of such coatings is limited and coatings must be reapplied periodically to preserve the seal.

A preferred method of constructing a masonry wall generally includes a single layer of concrete blocks since the above alternatives are relatively expensive, and modern concrete block designs may include colours, textures and surface features having all the aesthetic appeal of brick at a lower cost. Concrete block walls are of relatively low cost due to manufacturing and handling advantages and the skill involved in laying a block wall is less exacting than many other construction methods.

A conventional hollow building block especially in North America comprises interior and exterior parallel vertical walls with three transverse vertical webs spanning between the walls to form a rigid unitary block usually cast of concrete within a mould. The webs are inset from the transverse sides of the block such that the walls and web define two cavities within the block and, when like blocks are assembled into a constructed building wall, a cavity is defined between the outer transverse webs of adjacent blocks. The interior dimensions of the individual cavities of a block are slightly tapered to facilitate stripping of the mould from the block. Therefore, when overlapped blocks are vertically stacked, a vertical series of cavities results. Conventional metal flashing and weep holes at the ground level of the wall direct any water from within the vertical cavities outward.

Accordingly, there is a need for water controlling hollow building block which can be stacked in a single course to form a building wall. United Kingdom Patent No. 611,285 to Thomas Harvey 27 Oct. 1948 describes a hollow building block having longitudinal grooves in its upper and lower surfaces to impede the infiltration of water between the block and mortar joint and, to redirect the water to flow downwardly through cavities in the block. United Kingdom Patent No. 778,527 to John O'Connell 10 Jul. 1957 describes an improved hollow concrete block having three rows of cavities providing for one or more cavities in any vertical transverse cross section to prevent water migration through the inherently permeable material of the block. O'Connell also includes a groove in the upper surface of a block web to impede water flow.

Such proposed hollow block designs do not address the problem of water migrating from the exterior of the block to the interior by trickling down the side surfaces of transverse webs of vertically stacked blocks. Water will not trickle in a strictly vertical path down the side surface of the web but will form rivulets which run laterally and downwardly across the rough web surface in a random fashion. Since a mortar bead is placed only on the interior and exterior upper edges of a block, a gap is located in the central region of the web between the parallel mortar beads. Water flowing down the web of a block upon encountering the gap between blocks drips into the cavity of the block below. As a result, water may migrate across the webs of such proposed hollow blocks. The water may eventually pass from a crack in the exterior of the block wall to the interior of the block wall through a crack in the interior of the block wall or water may be absorbed by the interior mortar bead and bleed through to the interior of the building.

DISCLOSURE OF THE INVENTION

This invention proposes a hollow concrete block which addresses the above described disadvantages of conventional block designs in a novel manner.

According to one embodiment of the invention is provided a hollow building block, adapted for constructing a longitudinal vertically stacked array of like blocks, the block comprising:

- an interior vertical longitudinal wall;
- an exterior vertical wall, spaced apart from and parallel to the interior wall;
- at least one vertical web transverse to and spanning between the walls to form a rigid unitary block; and
- a plurality of vertical ribs at least one rib protruding from each side surface of each web.

According to another embodiment of the invention, there is provided a hollow building block, adapted for constructing a longitudinal vertically stacked array of like blocks, the block comprising:

(a) an interior vertical longitudinal wall;
(b) an exterior vertical wall, spaced apart from and parallel to the interior wall;
(c) at least one substantially vertical web transverse to and spanning between the walls to form a rigid unitary block; and
(d) means for impeding water migration through said block comprising: adapting at least one side surface of said web to direct water downwardly and thereby impede horizontal movement of said water across said web from said exterior wall toward said interior wall.

In a further embodiment of the invention, there is provided a hollow block, adapted for constructing a longitudinal vertically stacked array of like blocks having mortared joints, the block comprising:
(a) an interior vertical longitudinal wall;
(b) an exterior vertical wall, spaced apart from and parallel to the interior wall and having an upper surface contacting said mortared joint;
(c) at least one substantially vertical web transverse to and spanning between the walls to form a rigid unitary block; and
(d) means for impeding water infiltration into said block by facilitating shedding of said water downwardly away from the upper surface of said exterior wall.

In a further embodiment of the invention, there is provided a hollow building block, adapted for constructing a longitudinal vertically stacked array of like blocks having mortared joints, the block comprising:
(a) an interior vertical longitudinal wall;
(b) an exterior vertical wall, spaced apart from and parallel to the interior wall and having an upper surface contacting said mortared joint;
(c) at least one substantially vertical web transverse to and spanning between the walls to form a rigid unitary block, said web having an upper surface;
(d) means for impeding water infiltration into said block by facilitating shedding of water downwardly from the upper surface of said exterior wall, said means for impeding water infiltration comprising at least one sloped face extending downwardly from the upper surface of said exterior wall; and
(e) means for impeding water migration through said block, comprising:
  (i) at least one generally vertical rib protruding from at least one side surface of said web for directing water downwardly and thereby impeding horizontal movement of said water across said web from said exterior wall toward said interior wall; and
  (ii) at least one longitudinal groove in the upper surface of said web for redirecting any water migrating from said exterior wall toward said interior wall along the upper surface of said web onto the side surface of said web having said rib.

In a further embodiment of the invention, there is provided a hollow building block, adapted for constructing a longitudinal vertically stacked array of like blocks, the block comprising:
(a) an interior vertical longitudinal wall;
(b) an exterior vertical wall, spaced apart from and parallel to the interior wall;
(c) at least one substantially vertical web transverse to and spanning between the walls to form a rigid unitary block; and
(d) means for impeding water migration through said block wherein when said exterior wall is exposed to rain, at least one side surface of said web is adapted to bead water thereon, said water beads accumulating migrating water to form enlarged water droplets which flow downwardly under the force of gravity, thereby impeding horizontal movement of said migrating water across said web from said exterior wall toward said interior wall.

In a preferred embodiment, each web includes a longitudinal groove in its upper surface. Where architechural considerations do not prohibit the upper exterior edge of the exterior wall may be beveled.

The groove in the upper web surface impedes and redirects water flow to trickle downwardly through the cavities in the stacked blocks.

The ribs in the web impede flow across the side surfaces of the web and redirect water to flow downwardly through the cavities toward the conventional flashing and weep holes at the base of the block wall.

The bevelling of the exterior edge; prevents pooling of water in the exterior mortar joint area between vertically adjacent blocks; sheds water downwardly along the exterior surface of the exterior wall away from the mortar joint; and enables access to the joint for sufficient compaction of the mortar joint to minimize voids or cracking of the finished joint.

BRIEF DESCRIPTION OF THE DRAWINGS

In order that the invention may be readily understood, a preferred embodiment will be described by way of example with reference to the accompanying drawings.

DETAILED DESCRIPTION OF THE PREFERRED EMBODIMENT

Figure 1:
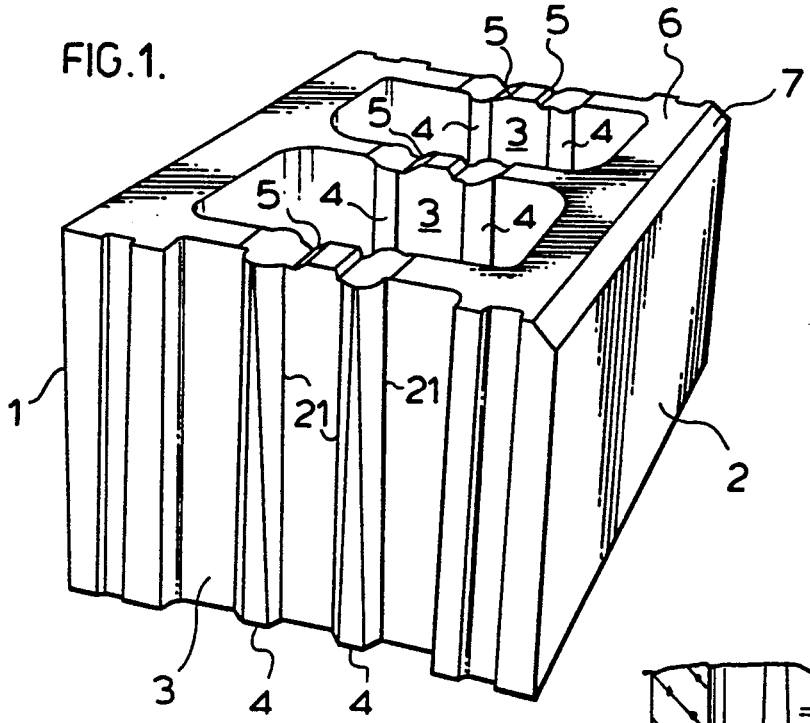
FIG. 1 is a perspective view of a single building block according to a preferred embodiment.

As shown in FIG. 1, a preferred embodiment of the invention takes the form of modifications to a standard rectangular concrete block. Conventionally, such blocks include: an interior vertical longitudinal wall 1; an exterior vertical wall 2; and three vertical webs 3. The walls 1 and 2 are spaced apart and are parallel to each other with the webs 3 transverse to and spanning between the walls 1, 2 to form a rigid unitary cast concrete block. It will be understood that the invention is equally applicable to any type of building block having walls and webs which define an interior cavity within the block. The choice of a conventional block design is preferred since marketplace acceptance is thereby more probable and the invention is more readily understood when a single known design is referred to in the following description and accompanying illustrations.

At least one vertical rib 4 protrudes from each side surface of each web 3. Each web 3 has at least one longitudinal groove 5 in the upper surface 6 of the web 3. In the illustrated embodiment each web 3 includes four ribs 4 and two grooves 5. The ribs 4 are arranged in two pairs of opposing ribs 4 on opposite sides of an associated web 3. The pairs of ribs 4 are transversely spaced from each other. The two grooves 5 are located between the pairs of ribs 4, and are symmetric about the longitudinal centreline of the block. The grooves 5 preferably extend transversely over the upper surfaces of adjacent ribs 4 to ensure that water dripping from a rib 4 of the block above does not by pass the groove 5 as described in detail below. For ease of casting the outward vertical edges of the ribs 4 are rounded.

This embodiment has been found by experiment to be an easily cast concrete block design which offers adequate impediments to water migration across the side surfaces of the webs 3 and across the upper surfaces 6 of the webs 3.

Figure 2:
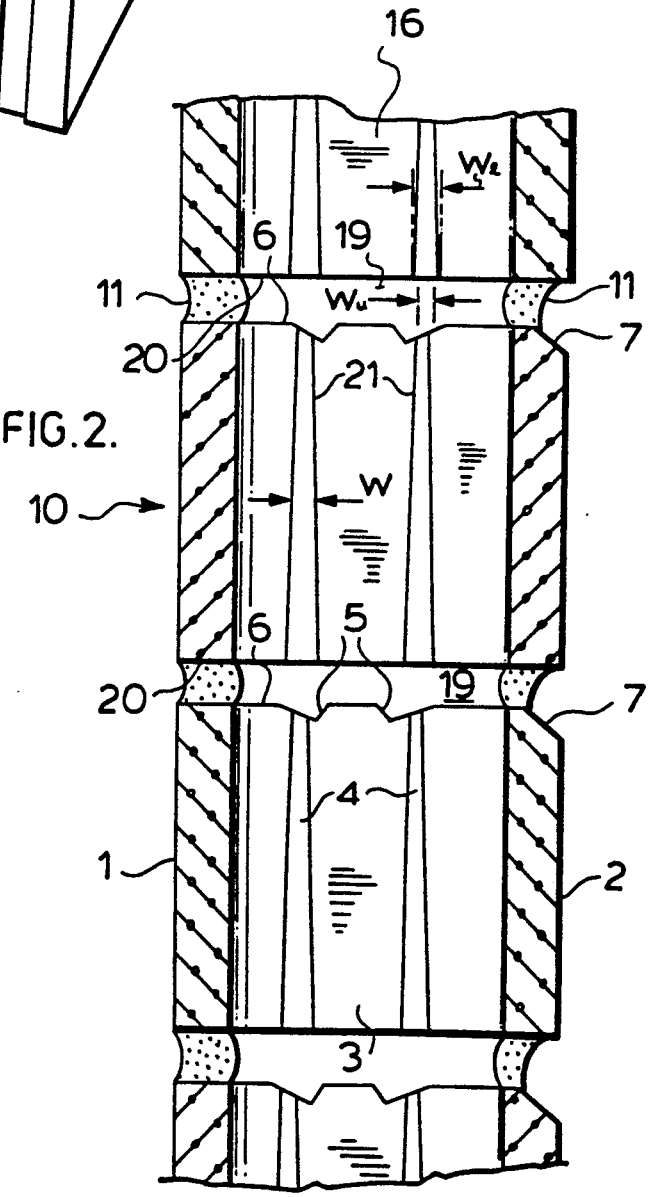
FIG. 2 is a transverse sectional view through the cavity of a vertically stacked array of like blocks showing, in particular, the web of the blocks.

As most clearly illustrated in FIG. 2, the ribs 4 are downwardly flared such that the transverse width "w" of the web 4 is greater at its lower end $w_l$ than at its upper end $w_u$. The upper exterior edge 7 of the exterior wall 2 is beveled to form an outwardly downwardly sloped face 7 in the embodiment shown in the drawings, however, this optional feature may be prohibited by architectural considerations despite its advantages.

Figure 3:
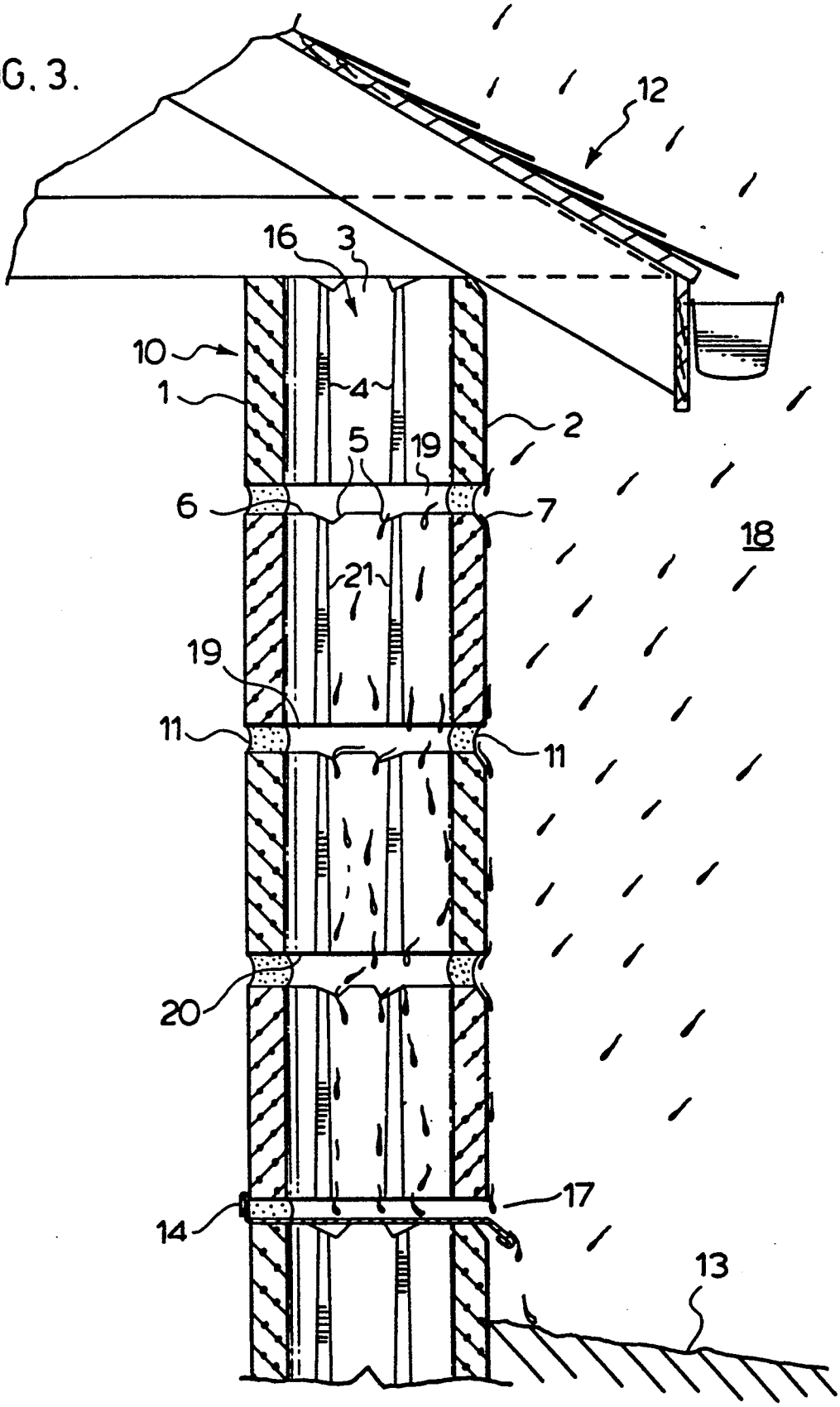
FIG. 3 is a sectional view like FIG. 2, showing the path of water penetrating and being directed by the block.

The manner in which the above described elements of the invention prevent and impede the infiltration of water into and migration through the block is illustrated in FIGS. 2 and 3 by way of example, An above-ground building wall is constructed of like blocks 10 in a vertically stacked array. It will be understood by those skilled in the art that a basement wall may be constructed in a like manner if some form of drainage is provided at the base of the wall to remove the water. A bead of mortar 11 is placed along the interior and exterior upper edges of a course of blocks 10 and along the side edges (not shown) of the stacked blocks 10 to join them together. At the top of the building wall a conventional roof structure 12 of any type is constructed sealing off the upper surface of the uppermost block 10 from weather. Above the ground level 13 conventional sheet metal flashing 14 is provided to direct any water, flowing down within the vertical cavities 15 of the building wall, outward through conventional weep holes 17 in the mortar joints 11, to the exterior of the building.

Water in the form of precipitation 18 contacts the exterior surface of the block's exterior wall 2 and runs down toward a mortar joint 11 below. The sloped face 7 of the block 10 facilitates shedding of water downwardly along the exterior surface. Conventional blocks without such a sloped face 7 have a mortar joint configuration similar to that illustrated in FIG. 2 on the interior wall 1 (as drawn on the left side). Such conventional mortar joints, especially an inset mortar joint, have been found to encourage pooling of water between blocks 10 in the area of the mortar joint 11. A typical mortar joint 11 is ⅜ inch high and due to inaccurate laying procedures or for architectural effect, the mortar joint 11 may be inset from the exterior surface creating a depressed mortar joint 11 within which water tends to accumulate. In addition, due to the tooled outwardly concave shape of the mortar joint 11, even a joint that has not been inset or depressed will encourage water accumulation, since water is held in the joint area by the surface tension of the water. Mortar and the block material itself are porous and permeable to a limited degree and some crack formation is practically inevitable. In any case however, when such pooling occurs, the probability of water infiltration into the block 10 is significantly increased. The sloped face 7 in preventing water accumulation in the mortar joint 11 area, therefore, reduces water infiltration.

The sloped face 7 also facilitates thorough compaction and complete tooling of the mortar joint 11 by allowing better access than conventional blocks especially when mortar joints 11 are inset for architectural effect. A typical mortar joint 11 as placed is approximately ⅜ inch in height. No measurement of the joint height is made by the bricklayer but a considerable degree of judgment is required to balance the amount of mortar, mortar viscosity, weight of block, tamping required, etc. to achieve the desired final height. If too low a mortar joint height is realized, its structural strength is not effected, however, tooling equipment may not fit properly between the blocks and inadequate compaction of the mortar joint 11 occurs. As a result of inadequate compaction, voids or cracks within the mortar joint 11 may exist which allow water to infiltrate into the cavity 16 of the block 10. The sloped face 7 in allowing improved tooling and compaction of the mortar joint 11, therefore, further reduces water infiltration.

Even given proper compaction and construction techniques, a degree of water infiltration will inevitably occur as a result of cracking due to thermal expansion and contraction of the wall, or settlement of the wall foundation. As well, the mortar and block material are inherently porous and permeable to a limited degree.

Referring to FIG. 3, water which infiltrates through the exterior mortar joint 11 or exterior wall 2 may run along the upper surface 6 of the web 3. As described above, no mortar is placed on the webs 3 and, therefore, a gap 19 exists between the upper surface 6 of the web 3 of a lower block 10, and the lower surface of the web 3 of an adjacent upper block 10. The depressed grooves 5 in the upper surface 6 of the web 3 intercept and redirect the flow of water to flow down the side surfaces of the web 3. It will be understood that the quantity of water flowing is relatively low and, therefore, a shallow groove 5 of ¼ inch depth, for example, has been found to be sufficient. In the preferred embodiment illustrated, two grooves 5 are used for added flow capacity and to increase the safety factor against migration of water along the web top surface 6. Having two grooves 5 symetric about the blocks centreline also allows either side of a block to be used for the interior or exterior provided the upper edge is not bevelled.

Water which flows downward on the side surfaces of the web 3 forms rivulets which meander side to side across the web 3 as they flow downward. The ribs 4 confine the path of the water rivulets impeding the flow of water from reaching the interior wall 1 in any significant amount. If water were allowed to contact the interior wall, a crack in the interior wall 1 or an interior mortar joint 11 would eventually allow water to penetrate into the building interior resulting in damage to the building structure, finishing materials or contents.

The most commonly used material for such building blocks is concrete which is cast in a mould. The block is stripped from the mould when partially set. The resulting surface finish of the block cavity and web is relatively porous and rough. It has been found by experiment that due to the porosity of the web and rib surfaces, any water flowing across the surface tends to form beads when abrupt changes in direction are encountered. These beads grow as they accumulate water flow by surface tension and, thereafter enlarged droplets form which flow downward under the force of gravity in a direct downward path. Therefore, when water flowing down the side surface of the web 3 encounters the relatively sharp inside corner 21 where a rib 4 protrudes from the web 3, the water beads up upon the sharp inside corner 21 of the rib 4. Water does not flow around the rib 4 but rather is trapped and beads up upon the sharp inside corner 21 of the rib 4. The surface tension of water and porosity of the surface prevent water from flowing around the inside corner 21 since water will span across the corner 21 becoming trapped. The water then flows downwardly toward the adjacent lower block 10.

The ribs 4 are tapered having a greater width at their bottom than at their top. The cavity 16 with each block 10 is conventionally tapered slightly to enable stripping of the mould. The cavity taper is such that the cavity is larger at the upper surface of the block than at its lower surface. Accordingly, the tapering of the ribs 4 does not present a difficulty in stripping of the mould away from the upper block surface. The outward vertical edges of the ribs 4 are rounded to further facilitate stripping of the mould.

As water flows down the tapered rib 4, the water encounters the gap 19 between adjacent stacked blocks 10. The tapering of the ribs 4 ensures that when water drops fall from the rib 4 of an upper block 10 to a lower block 10, the major portion of the water drops fall between the ribs 4 or between the rib 4 and the exterior wall 2. The tapering of the ribs 4 allows for a slight degree of misalignment of ribs 4 when the blocks are laid. Due to the roughness and porosity of the web surfaces it has been found that water does not flow an appreciable distance along the bottom surface 20 of the web 3 but rather water forms droplets on the bottom surface 20 which enlarge until their weight forces droplets to fall to the adjacent lower block 10. Preferably the grooves 5 extend transversely over the upper surface of an adjacent rib 4 to capture any drops of water which have run along the bottom surface 20 and drop downward from the bottom surface of the rib 4 or web 4 above onto the top surface 6 of the lower block. Therefore, no significant amount of water can migrate across the web 3 to the web 3 area bounded by the interior wall 1 and the rib 4 adjacent the interior wall 1. As a result, the interior wall 1 remains relatively dry and penetration of water through the interior wall 1 is greatly reduced to a degree which is acceptable and insignificant.

It will be appreciated that depending upon the amount of water flow, a block 10 in accordance with the invention may include on each side web surface: a single rib; a single rib and a single groove; or any multiple combination of ribs and grooves. Numerous modifications and changes may be made in details disclosed above without departing from the substance of the invention as set out in the claims below.

The embodiment of the invention in which an exclusive right or property is claimed are defined as follows:

1. A hollow building block, for use in constructing a longitudinal vertically stacked array of like blocks, the block comprising:

(a) an interior vertical longitudinal wall;

(b) an exterior vertical wall, spaced apart from and parallel to the interior wall;

(c) at least one substantially vertical web having side faces transverse to and spanning between the walls to form a rigid unitary block; and (d) having on at least one of said side faces of said web means for impeding water migration across said web from said exterior wall to said interior wall.

2. The block of claim 1 wherein said web includes an upper surface and said block further includes a means for redirecting water, whereby any water migrating from said exterior wall toward said interior wall along said upper surface is redirected onto at least one of said side surfaces of said web.

3. The block of claim 2 wherein said redirecting means includes at least one groove in the upper surface of said web.

4. The block of claim 3 wherein said groove in substantially V-shaped.

5. The block of claim 1 wherein said means for impeding water migration comprises at least one corner.

6. The block of claim 5 wherein said sharp corner comprises the juncture of said side surface and a rib protruding from said side surface.

7. The block of claim 6 wherein said rib is generally vertical.

8. The block of claim 7 wherein said rib is tapered having a grater transverse width at its lower end that at its upper end.

9. The block of claim 6 wherein said rib has rounded generally vertical outward edges.

10. The block of claim 7 wherein four of said ribs are located on each web, and said ribs are arranged in two pairs of opposed ribs on opposite sides of the web, and wherein said redirecting means directs water generally between said pairs of ribs.

11. The block of claim 1 wherein said means for impeding water migration comprises the juncture of said side surface and a rib protruding from said side surface.

12. The block of claim 11 wherein said web has a height and said rib is generally vertical and extends substantially the full height of said web.

13. The block of claim 12 wherein said rib is tapered having a greater transverse width at its lower end that at its upper end.

14. The block of claim 11 wherein the outward vertical edges of said ribs are rounded.

15. The block of claim 12 wherein four of said ribs are located on each web, said ribs being arranged in two pairs of longitudinally opposed ribs on opposite sides of the web, the pairs being transversely spaced from each other, and wherein said redirecting means directs water generally between said pairs of ribs.

16. The block of claim 1 or 2 wherein said exterior includes an upper surface, said block further comprising means for impeding water infiltration into said block by facilitating shedding of said water downwardly away from the upper surface of said exterior wall.

17. A hollow block, adapted for constructing a longitudinal vertically stacked array of like blocks having mortared joints, the block comprising:

(a) an interior vertical longitudinal wall;

(b) an exterior vertical wall, spaced apart from and parallel to the interior wall and having an upper surface contacting said mortared joint;

(c) at least one substantially vertical web transverse to and spanning between the walls to form a rigid unitary block; and (d) means for impeding water infiltration into said array of like blocks by facilitating shedding of said water downwardly away from the upper surface of said exterior wall.

18. The block of claim 17 wherein said means for impeding water infiltration includes at least one sloped face extending downwardly from the upper surface of said exterior wall.

19. The block of claim 17 or 18 wherein said means for impeding water infiltration allows manual access to said mortar joint for thorough compaction and tooling of said mortar joint.

20. A hollow building block, adapted for constructing a longitudinal vertically stacked array of like blocks having mortared joints, the block comprising:

(a) an interior vertical longitudinal wall;

(b) an exterior vertical wall, spaced apart from and parallel to the interior wall and having an upper surface contacting said mortared joint;

(c) at least one substantially vertical web transverse to and spanning between the walls to form a rigid unitary block, said web having an upper surface and side surfaces;

(d) means for impeding water infiltration into said array of like blocks by facilitating shedding of water downwardly from the upper surface of said exterior wall, said means for impeding water infiltration comprising at least one sloped face extending downwardly from the upper surface of said exterior wall; and (e) means for impeding water migration across said web, comprising:

(i) at least one generally vertical rib protruding from at least one of said side surfaces of said web for directing water downwardly and thereby impeding horizontal movement of said water across said web from said exterior wall toward said interior wall; and (ii) at least one longitudinal groove in the upper surface of said web for redirecting any water migrating from said exterior wall toward said interior wall along the upper surface of said web onto the side surface of said web having said rib.

21. The block of claim 20 wherein said groove is substantially V-shaped, and extends transversely substantially over an upper surface of said web and said rib.

22. The block of claim 20 or 21 wherein four of said ribs are located on each web, said ribs being arranged in two pairs of longitudinally opposed ribs on opposite sides of the web, the pairs being transversely spaced from each other, and wherein said groove directs water generally between said pairs of ribs.

23. The block of claim 22 having three webs and said block being cast of concrete.

24. A hollow building block, adapted for constructing a longitudinal vertically stacked array of like blocks, the block comprising:

(a) an interior vertical longitudinal wall;

(b) an exterior vertical wall, spaced apart from and parallel to the interior wall;

(c) at least one substantially vertical web transverse to and spanning between the walls to form a rigid unitary block and having side surfaces; and (d) means for impeding water migration across said web wherein when said exterior wall is exposed to rain, at least one of said side surfaces of said web being water permeable and having means to bead water thereon, said water bead accumulating migrating water to form enlarged water droplets which flow downwardly under the force of gravity, thereby impeding horizontal movement of said migrating water across said web from said exterior wall toward said interior wall.

25. The block of claim 24 wherein said block is cast of concrete.

26. The block of claim 24 or 25 wherein said water migration impeding means includes at least one relatively sharp corner.

27. The block of claim 26 wherein said sharp corner comprises the juncture of said side surface and a rib protruding from said side surface, the porosity of said side surface and the surface tension of said water in said corner impeding the movement of water around said rib toward said interior wall.

28. A method of controlling water movement through a longitudinal vertically stacked array of like blocks having mortared joints comprising:

(i) providing a plurality of hollow blocks having:

(a) an interior vertical longitudinal wall;

(b) an exterior vertical wall, spaced apart from and parallel to the interior wall and having an upper surface contacting said mortared joint;

(c) at least one substantially vertical web having substantially vertical side faces, said web being transverse to and spanning between the walls to form a rigid unitary block, said web having an upper surface;

(d) a means on at least one of said side faces of said web for impeding water migration horizontally across said web from said exterior wall to said interior wall; and (e) means for impeding water infiltration into said array of blocks by facilitating shedding of said water downwardly away from the upper surface of said exterior wall, (ii) placing a plurality of blocks side-by-side with mortar therebetween to form a course of said blocks;

(iii) providing beads of mortar along an upper surface of the interior and exterior vertical walls of said blocks of the previous course;

(iv) stacking said blocks on the beads of mortar of step (iii) and placing mortar therebetween to form another course of said blocks;

(v) repeating steps (iii) and (iv) until a desired vertically stacked array of said blocks is achieved; and (vi) sealing off the uppermost course of said array of blocks from weather.

29. The method of claim 28, further comprising channelling water out of the lowermost course of said array of blocks.

* * * * *